US005673527A

United States Patent [19]

Coston et al.

[11] Patent Number: 5,673,527

[45] Date of Patent: Oct. 7, 1997

[54] REFRACTORY TILE, MOUNTING DEVICE, AND METHOD FOR MOUNTING

[75] Inventors: Kent R. Coston, Hubbardston; Brian T. Lenihan, Newburyport; James C. Zampell, Wenham, all of Mass.

[73] Assignee: Zampell Advanced Refractory Technologies, Inc., Newburyport, Mass.

[21] Appl. No.: 523,689

[22] Filed: Sep. 5, 1995

[51] Int. Cl.[6] ..... F27D 1/14

[52] U.S. Cl. ..... 52/506.02; 52/385; 52/513; 52/563; 52/747.11; 122/6 A; 122/6 R; 110/336

[58] Field of Search ..... 52/385, 506.05, 52/506.02, 563, 513, 514, 747.13, 747.1, 747.11, 747.12; 110/324, 325, 336; 122/6 A, 6 R; 411/84, 85, 104, 103

[56] References Cited

U.S. PATENT DOCUMENTS

| | | | |
|---|---|---|---|
| 1,823,927 | 9/1931 | Bailey et al. | 122/6 A |
| 1,886,314 | 11/1932 | Tenney | 122/6 A |
| 2,536,039 | 1/1951 | Craven | 52/513 X |
| 2,889,698 | 6/1959 | Stevens | 122/6 A X |
| 3,356,401 | 12/1967 | Bertram | 52/506.05 |
| 3,838,665 | 10/1974 | Astrom | 122/6 A |
| 3,969,011 | 7/1976 | Yamada | 411/104 X |
| 4,619,314 | 10/1986 | Shimoda | 122/6 A X |
| 4,773,356 | 9/1988 | Black | 110/336 X |
| 4,885,888 | 12/1989 | Young | 52/564 X |
| 4,964,594 | 10/1990 | Webb | 411/103 X |
| 5,063,861 | 11/1991 | Imogawa et al. | 110/336 |
| 5,222,851 | 6/1993 | Dickerson | 411/84 X |

FOREIGN PATENT DOCUMENTS

| | | | |
|---|---|---|---|
| 0529941 | 12/1921 | France . | |
| 2555300 | 5/1985 | France . | |
| 2725505 | 4/1996 | France . | |
| 9016206 | 2/1991 | Germany . | |
| 4226284 | 2/1994 | Germany . | |
| 4324423 | 4/1994 | Germany . | |
| 4303606 | 9/1994 | Germany | 110/325 |
| 2950475 | 11/1995 | Germany . | |
| 0870223 | 4/1989 | Netherlands . | |

*Primary Examiner*—Carl D. Friedman
*Assistant Examiner*—Winnie Yip
*Attorney, Agent, or Firm*—Hale and Dorr LLP

[57] ABSTRACT

A ceramic tile is mounted to the wall of an incinerator or other high temperature and/or corrosive environment with a stud assembly that includes a threaded stud and a ceramic T-nut. The ceramic T-nut thermally shields the stud to protect it from oxidation and corrosion, and reduces cracking in tile because the T-nut and the tile have similar thermal expansion. The T-nut is accessible through a small bore.

26 Claims, 3 Drawing Sheets

REFRACTORY TILE, MOUNTING DEVICE, AND METHOD FOR MOUNTING

FIELD OF THE INVENTION

This invention relates to a refractory tile for a wall, and to a method and apparatus for mounting such a tile in a corrosive, high temperature environment.

BACKGROUND OF THE INVENTION

In the interior of a waste-to-energy incinerator, the temperature of the heat can reach about 2400° F. (about 1315° C.). To produce energy from this heat, vertically oriented boiler tubes for carrying feedwater are positioned in or along the walls of the incinerator. To protect the tubes from the high temperatures and corrosive atmosphere, the walls and boiler tubes are covered with protective tiles. The heat turns the water in the tubes to steam, which is directed to a turbine for generating power.

The tiles most commonly used on the walls of such incinerators are made of silicon carbide (SiC), which is a ceramic. An example of such a tile, as it is mounted on a wall, is shown in FIG. 1, and a plan view of a tile is shown in FIG. 2. A tile 10 is mounted so that an inner surface 12 faces an interior of the incinerator, and an outer surface 14 faces a side wall 16. Vertically oriented water-carrying boiler tubes 18 extend along wall 16. Outer surface 14 of the tile has arcuate portions 20 for conforming to the shape of tubes 18.

Tile 10 is mounted to wall 16 with a threaded stud 24, a nut 26, and a washer 28, all of which are typically made of stainless steel. Stud 24 is welded to the wall to extend in a direction perpendicular to the wall. Typically, SiC mortar (not shown) is also put over tubes 18. Tile 10, which has a bore 30 centered in the tile along its thickness direction, is placed against the wall so that stud 24 extends through the bore. Washer 28 and nut 26 are placed over the stud, and nut 26 is tightened so that the stud assembly and the mortar fix the tile to the wall. Bore 30 can then be filled with mortar to form a plug that covers the nut and washer, or bore 30 is filled with mortar and covered with a refractory cap. To accommodate stud 24, bore 30 has a narrow diameter portion 32 that has a diameter that is slightly larger than the diameter of stud 24, and a wider diameter portion 34 that has a diameter that is slightly larger than the diameter of washer 28. Portion 34 also accommodates a socket or wrench that circumferentially tightens nut 26.

While this type of tile performs well in the short-term, there can be long-term failures. Over time, the nut, washer, and stud can oxidize and corrode. Moreover, because of the oxidating and corrosion of stud 24, nut 26, and washer 28, the expansion causes spider cracking to occur in the tile due to differences in thermal expansion.

Another idea for a tile is one with an angled opening extending upwardly and inwardly from its outer face. To mount such a tile, a rod is welded to the wall at an upwardly extending angle to form a simple hook. The tile is simply hung on the hook by moving it at an angle to the wall. It is difficult, however, to maintain such a tile wall because it is hard to replace a single tile without also having to remove or otherwise disturb adjacent tiles.

Accordingly, it is an object of the present invention to provide a tile, a mounting device, and a method for mounting the tile so that the tile and mounting device resist long-term failure, and so that it is easy to install and maintain the tiles.

SUMMARY OF THE INVENTION

The present invention includes a tile, a stud assembly for mounting the tile to the wall of an incinerator, and a method for mounting a tile. The stud assembly has a stud for connection to the wall and a nut over an inner end (nearer the interior of the incinerator) of the stud. The nut is preferably made of ceramic, such as SiC, and preferably covers the inner end of the stud to protect the stud from the heat of the incinerator.

The nut is preferably a T-nut that has a post with a threaded bore for mating with the stud, and a head that is integral with the post (thus forming a T-shaped cross-section). The T-nut is accessible for tightening through an opening that is preferably much smaller than the diameter of the head of the T-nut, thus reducing the T-nut's exposure to the heat and/or corrosion from the interior of the incinerator.

The tile has a channel that is sized and shaped to accommodate the nut. The channel extends from one side of the tile to a location within the perimeter of the tile, preferably at the center of the tile.

The stud may be made of stainless steel or some other material that can be welded to the wall. Alternatively, the stud may include a holder that can be welded to the wall and a ceramic stud mounted in the holder. In the latter case, the stud is preferably made of the same material as the tile and the nut, preferably SiC. An annular ceramic member can be provided over part of the stud at the end of the stud that is welded or otherwise connected to the wall. The annular ceramic member cooperates with the nut to substantially enclose the stud when the nut is tightened.

The tile and the stud assembly of the present invention resist corrosion, oxidation, and other effects of long-term exposure to high temperature; reduce differences in thermal expansion and thus the likelihood of cracking; and provide for convenient installation and maintenance. In the preferred embodiment, because there is only a small opening in the tile exposed to the heat and/or corrosion in the mounting environment, and because the exposed part of the stud assembly is made of a ceramic material, the design of the tile and stud assembly resist corrosion and oxidation. The small portion of the stud assembly that is exposed to the corrosion and/or heat of the environment has a thermal expansion that is similar to that of the tile, thus reducing the likelihood of cracking in the tile. These benefits are achieved with a tile that can easily be installed and that can be removed for maintenance without it being necessary to remove adjacent tiles. Other features and advantages will become apparent from the following detailed description, the drawings, and the appended claims.

DETAILED DESCRIPTION

Figure 3:
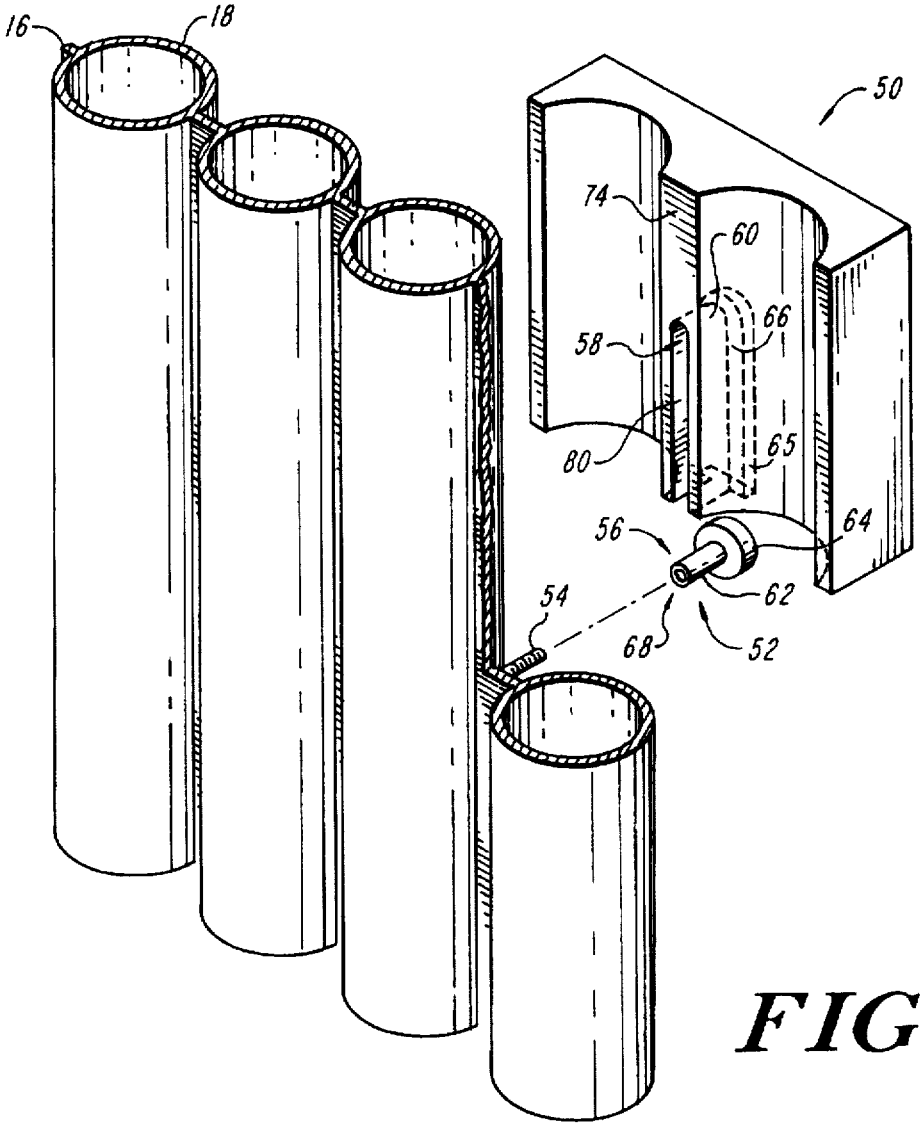
FIG. 3 is a perspective view of a wall, a tile, and a stud assembly according to the present invention.
Figure 4:
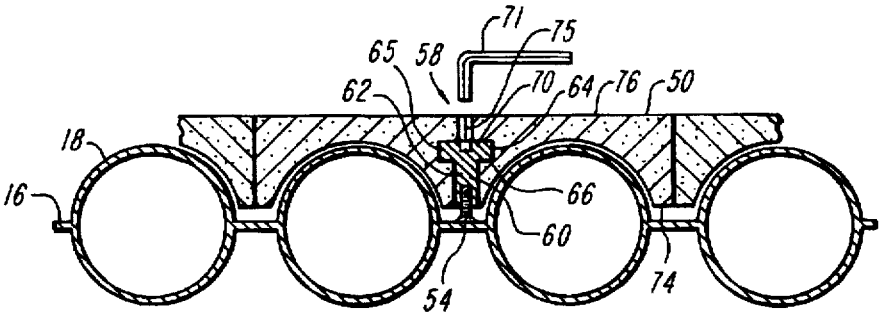
FIG. 4 is a cross-sectional view of a tile and a stud assembly according to the present invention, shown mounted to a wall.
Figure 5:
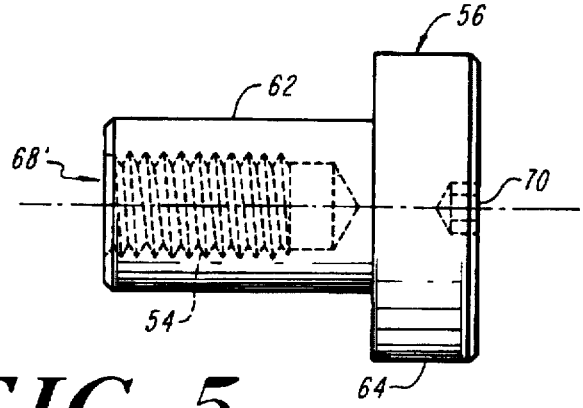
FIG. 5 is a side view of the stud assembly of FIG. 3.

Referring to FIGS. 3–5, a protective refractory tile 50 and a stud assembly 52 are designed so that the tile can be easily mounted to incinerator wall 16 with vertically oriented tubes 18, or some other high temperature and/or corrosive environment. The stud assembly is protected from oxidation or corrosion through long-term exposure; and the likelihood of the tile cracking is reduced. The tile is preferably made from SiC and protects the walls from high temperatures and/or corrosion.

Stud assembly 52, which holds tile 50 to wall 16, includes a threaded stud 54 and a threaded T-nut 56. In the embodiment that is shown, stud 54 is preferably made of stainless steel and is welded to wall 16. Alternatively, the stud can be made of ceramic and can be held in a holder that is welded to the wall.

T-nut 56, which is preferably made from ceramic such as SiC or high alumina, has a generally cylindrical post 62 and a generally cylindrical head 64 integrally formed with the post. Post 62 has a central axial threaded bore 68 which extends inwardly from its outer end and which is sized and shaped to receive stud 54. At its outer surface, head 64 has a short central bore 70 for receiving an adjusting tool, such as an Allen wrench 71.

Tile 50 receives stud assembly 52 in an appropriately sized and shaped bore 58. Bore 58 extends along the thickness direction of tile 50 at the center of the length and width of the tile and has three sections. A first section 60 for receiving post 62 of T-nut 56 extends inwardly from an outer surface 74 of the tile, and has a diameter that is slightly wider than post 62, and a length that is slightly less than that of post 62. A second section 75 extends outwardly from an inner surface 76 of tile 50, and is preferably much smaller in diameter than head 64 of T-nut 56, but is large enough to accommodate a tool (such as an Allen wrench 71) for adjusting head 64 of T-nut 56. Because this second section is small, it allows for adjustment while minimizing the exposure of head 64 to the high temperature in the interior of the incinerator. Between the first section 60 and second section 75 is a third section 65 for receiving head 64. Section 65 is slightly wider in diameter than head 64 of T-nut 56 so that head 64 can rotate within section 65. Where sections 60 and 65 meet, a first annular shoulder 66 is formed, and where sections 65 and 75 meet, a second annular shoulder is formed. When head 64 is tightened, it abuts shoulder 66.

When a tile is installed, T-nut 56 cannot be put over stud 54 through the inner surface of the tile because second section 75 of the bore is smaller than head 64. To receive T-nut 56 at the center of tile 50, the tile has a channel 80 formed in its outer surface to allow the T-nut to be slid longitudinally relative to the tile to a position within the perimeter of the tile, preferably at the center of the tile. Channel 80 has an outer portion 82 that is slightly wider than the diameter of post 62, and an inner portion 84 (shown in dashed line) that is a little wider than head 64. The channel thus has a T-shaped cross-section.

Figure 1:
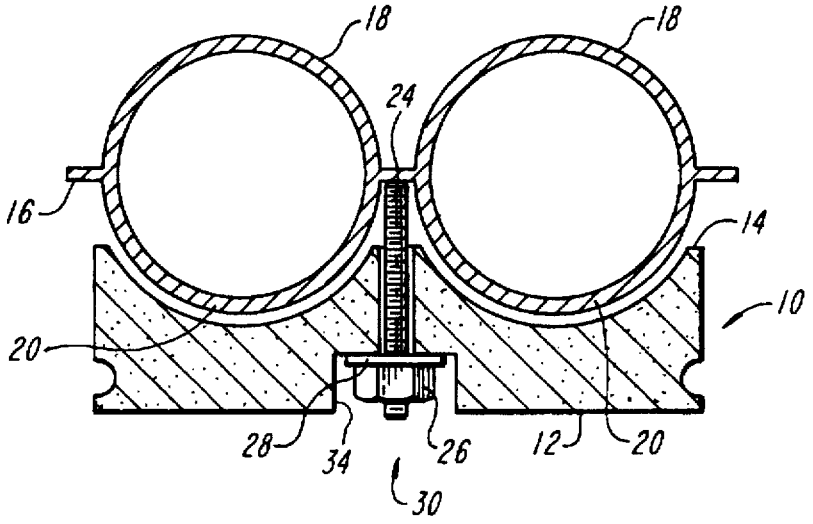
FIG. 1 (PRIOR ART)
FIG. 1 is a cross-sectional view of a tile mounted against a wall according to a known prior art structure.
Figure 2:
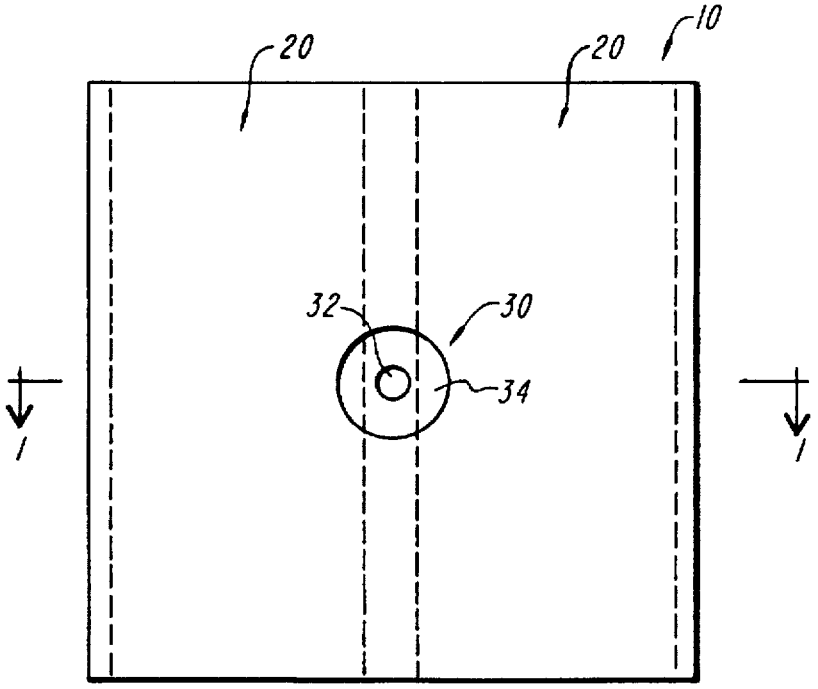
FIG. 2 (PRIOR ART)
FIG. 2 is a plan view of the known tile of FIG. 1.
Figure 6:
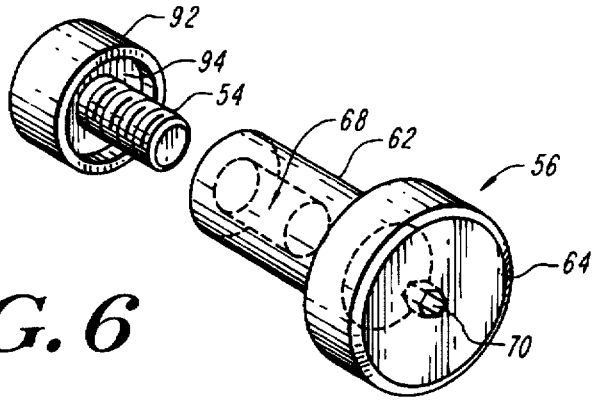
FIG. 6 is a perspective view of a stud assembly with a stud with an annular endpiece.
Figure 7:
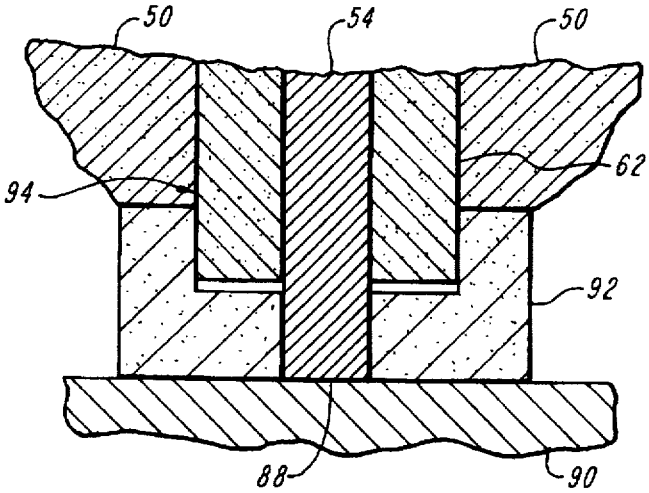
FIG. 7 is a cross-sectional view of the stud assembly of FIG. 6, shown mounted to a wall.

The T-nut covers the stud's inner end, which otherwise would be exposed (as in FIG. 1), and also covers part of the side of the stud. The stud assembly can be modified so that the threaded stud is completely enclosed. Referring to FIGS. 6 and 7, stud 54 may be covered partway at its outer end 88 with an annular ceramic endpiece 92. The endpiece is generally cylindrical and has a central bore for receiving stud 54. At the inner end of endpiece 92 is an annular groove 94 around the bore. The length of endpiece 92 and the depth of channel 94 are sized so that post 62 extends into groove 94 when T-nut 56 is tightened over stud 54. Accordingly, stud 54 is substantially enclosed by endpiece 92 and T-nut 56. Because these enclosing pieces are preferably both made of ceramic, the stud is well protected.

Referring again to FIGS. 3 and 4, to mount a tile, stud 54 (either a threaded member itself or a holder for holding a threaded member) is welded to the wall, and T-nut 56 is partially screwed over the stud. The tile is positioned over the T-nut with channel 80 extending downwardly as shown in FIG. 3. The tile is moved vertically downwardly in a plane parallel to the wall so that T-nut 56 slides within and relative to channel 80. When the tile is centered, it should rest on T-nut 56 without further manual support. T-nut 56 is then leveled and tightened. Typically, mortar (not shown) is provided over the tubes before the tile is mounted, as is done with some prior tiles.

During initial installation, a first row of these tiles is mounted along the base of the wall, and then tiles are added one row at a time by working upward. Mortar is typically provided between adjacent tiles. To remove the tiles, these steps can be performed in reverse order.

To remove a single tile from a tiled wall for replacement, the T-nut can be completely unscrewed so that the tile and the T-nut can be removed together in a direction perpendicular to the wall. Unlike a tile with a hook as described above in the background, a single tile according to the present invention can be removed without lateral movement that could contact adjacent tiles. To replace a tile by reversing these steps, the T-nut is inserted in the channel and centered. It can be held in place with an Allen wrench (or some other tool) extending through second section 75 of the bore in the tile. The T-nut is then screwed over the stud.

This method makes removal and replacement convenient because it allows tiles to be mounted in a direction perpendicular to the wall without lateral movement relative to adjacent tiles. Thus, the wall of tiles can be maintained with replacement tiles without disturbing adjacent tiles.

In an exemplary embodiment of the present invention, stud 54 is made of stainless steel and is 1.05 inches long and ⅜ inch in diameter. The nut is a T-nut that is made of SiC and that has a post about one inch long and 0.63 inches in diameter, with a bore about 0.94 inches deep. The head of the T-nut is about 0.37 inches high and 1.13 inches in diameter, and its bore is 0.15 inches deep with a 3/16 inch hexagonal cross-section for receiving an Allen wrench. Tile 50 is square, 7.88 inches to a side and 1.9 inches thick (at its widest part), and has a bore with first, second, and third sections (as described above) that are 0.69, 0.2, and 1.19 inches in diameter, and have depths of 0.87, 0.59, and 0.44, inches, respectively. In this exemplary embodiment, the ratio of the diameters of the head of the T-nut and the second section of the bore in the tile is about 5.6, so the ratio of the areas is about 31. Accordingly, the area needed to access the head of the T-nut is much smaller than the area of the nut.

Each part of the stud assembly that is made of ceramic is preferably made of the same material as the tile (i.e., typically SiC). This similarity allows the parts to thermally expand by a similar amount, thus reducing the likelihood of spider cracking. Other types of ceramics, such as high alumina, however, can be used instead of SiC.

Having described a preferred embodiment of the present invention, it should be apparent that other modifications can be made without departing from the scope of the invention has defined by the appended claims. For example, while this description of the tile has been for use with an incinerator, the tile and mounting method can be used in any high temperature and/or corrosive environment, such as a furnace or a gasification system. While certain dimensions have been cited for an exemplary embodiment, other dimensions can be used for these components. For example, the tile can be in the range of 1 inch to 24 inches square.

What is claimed is:

1. A tile assembly for use on a surface of a wall in a high temperature and/or corrosive environment, the tile assembly comprising:

a tile including:

an outer surface for facing the wall, an inner surface for facing away from the wall, and a bore extending from the outer surface to the inner surface along a thickness direction of the tile, wherein the bore includes:

a first section extending inwardly from the outer surface, a second section extending outwardly from the inner surface, and a third section intermediate the first and second sections, the third section having a diameter greater than the diameters of the first and second sections; and a stud assembly for holding the tile to the wall and including:

a stud for connection to the wall, and an adjustable nut mounted over the stud, the nut being disposed in the third section of the bore and having a diameter greater than that of the first and second sections of the bore.

2. The tile assembly of claim 2, wherein the nut has means for allowing the nut to be adjusted, the allowing means being located to be accessible through the second section of the bore.

3. The tile assembly of claim 2, wherein the nut completely covers an end of the stud to protect the stud.

4. The tile assembly of claim 3, wherein the nut has a head that covers the end of the stud, and a post that is integrally formed with the head, the post having a bore for receiving the stud.

5. The tile assembly of claim 1, wherein the nut has a head and a post, the post having a bore for receiving the stud, the nut having a T-shaped cross-section.

6. The tile assembly of claim 1, wherein the stud is a threaded rod and the stud assembly includes a holder for mounting to the wall, the holder covering part of the stud at an outer end, the holder having a shape and size so that the nut and the holder cooperate to substantially enclose the stud when the nut is appropriately adjusted.

7. A tile assembly for use on a surface of a wall in a high temperature and/or corrosive environment, the tile assembly comprising:

a tile including:

an outer surface for facing the wall, an inner surface for facing away from the wall, a bore extending from the outer surface to the inner surface along a thickness direction of the tile; and a stud assembly for holding the tile to the wall and including:

a stud for connection to the wall, and an adjustable nut mounted over the stud, the stud and nut at least partially disposed in the bore;

wherein the tile has a channel extending from a side of the tile and extending at least to the bore, the channel being sized and shaped to receive the nut.

8. The tile assembly of claim 7, wherein bore is at a center of the tile and the channel terminates at the center of the tile.

9. The tile assembly of claim 7, wherein the nut has means by which the nut is adjustable, the means being accessible through the second section of the bore.

10. The tile assembly of claim 7, wherein the stud is made of ceramic.

11. A tile assembly for use on a surface of a wall in a high temperature and/or corrosive environment, the tile assembly comprising:

a tile including:

an outer surface for facing the wall, an inner surface for facing away from the wall, and a bore extending from the outer surface to the inner surface along a thickness direction of the tile; and a stud assembly for holding the tile to the wall and including:

a holder for connection to the wall, a threaded stud held partly in the holder, and an adjustable nut mounted over the stud, the stud and nut at least partially disposed in the bore.

12. The tile assembly of claim 11, wherein the stud is a threaded member, and the holder and the nut cooperate to completely enclose the stud.

13. The tile assembly of claim 11, wherein the threaded stud is made of ceramic.

14. A tile assembly for use on a surface of a wall in a high temperature and/or corrosive environment, the tile assembly comprising:

a tile including:

an outer surface for facing the wall, an inner surface for facing away from the wall, and a bore extending from the outer surface to the inner surface along a thickness direction of the tile, the bore including:

a first section extending inwardly from the outer surface, a second section extending outwardly from the inner surface, and a third section intermediate the first and second sections, the third section having a diameter greater than the diameters of the first and second sections, the third section and the first section defining a first shoulder with a first face perpendicular to the thickness direction of the tile and the third section and the second section defining a second shoulder with a second face perpendicular to the thickness direction.

15. The tile assembly of claim 14, further comprising a stud assembly for holding the tile to the wall and having:

a stud for connection to the wall, and an adjustable nut mounted over the stud, the stud and nut at least partially disposed in the bore of the tile, the nut having a portion with a diameter greater than the diameter of the second section and smaller than the diameter of the third section.

16. The tile assembly of claim 14, wherein the tile is made of a refractory material for use in a high temperature environment.

17. The tile assembly of claim 14, wherein the inner surface is rounded with a concave arcuate portion for conforming to a tube.

18. A method for mounting on a wall a tile having a channel, and a bore the tile for use in a high temperature and/or corrosive environment, the method comprising the steps of:

(a) mounting a stud on the wall;

(b) providing a nut on the stud;

(c) aligning the nut with a channel in the tile;

(d) moving the tile in a direction parallel to the wall so that the nut slides in the channel; and (e) tightening the nut over the stud.

19. The method of claim 18, wherein, after step (a) and before step (b), the method includes moving a nut along the channel in the tile.

20. A tile for use on a surface of a wall in a high temperature and/or corrosive environment, the tile including:

an outer surface for facing the wall, an inner surface for facing away from the wall, a bore extending from the outer surface to the inner surface along a thickness direction of the tile, the bore including:

a first section extending inwardly from the outer surface, a second section extending outwardly from the inner surface, and a third section intermediate the first and second sections, the third section having a diameter greater than the diameters of the first and second sections, wherein the second section is a hole, and first and second slots extending from a side of the tile to meet the first and third sections of the bore.

21. A tile for use on a surface of a wall in a high temperature and/or corrosive environment, the tile having a perimeter and comprising:

an outer surface for facing the wall;

an inner surface for facing away from the wall;

a bore extending from the outer surface to the inner surface along a thickness direction of the tile; and the tile having a channel in the outer surface extending from a side of the tile to the bore.

22. The tile of claim 21, wherein the bore includes:

a first section extending inwardly from the outer surface, a second section extending outwardly from the inner surface, and a third section intermediate the first and second sections, the third section having a diameter greater than the diameters of the first and second sections.

23. The tile of claim 22, wherein the first and third sections of the bore form a first shoulder and the second and third sections of the bore form a second shoulder, the first and second shoulders at flat surfaces in respective first and second planes perpendicular to the thickness direction.

24. The tile of claim 21, wherein the channel has at least a first portion with a width as large as the diameter of the third section.

25. The tile of claim 24, wherein the channel has a second portion with a width about equal to the diameter of the first section.

26. The tile of claim 21, wherein the channel terminates at the bore.

* * * * *